US008869323B2

(12) United States Patent
Chung et al.

(10) Patent No.: US 8,869,323 B2
(45) Date of Patent: Oct. 28, 2014

(54) COMBINATION BED THAT IS ASSEMBLED AND DISASSEMBLED EASILY AND QUICKLY

(75) Inventors: Chen-Yu Chung, Taichung (TW); Sheng-Chi Chung, Taichung (TW)

(73) Assignee: Dong Guan Changxin Electronics Technology Co., Ltd., Dongguan (CN)

( * ) Notice: Subject to any disclaimer, the term of this patent is extended or adjusted under 35 U.S.C. 154(b) by 427 days.

(21) Appl. No.: 13/311,657

(22) Filed: Dec. 6, 2011

(65) Prior Publication Data

US 2013/0139314 A1 Jun. 6, 2013

(51) Int. Cl.
*A47C 19/02* (2006.01)

(52) U.S. Cl.
USPC ..... 5/132; 5/201; 5/207; 5/131; 5/282.1

(58) Field of Classification Search
CPC .. A47C 19/005; A47C 19/021; A47C 19/024; A47C 19/025; A47C 19/04; A47C 19/027; A47C 19/022; A47C 19/124; A47C 19/02; A47C 19/045; F16B 12/54; F16B 12/56; F16B 12/58
USPC ..... 5/131, 132, 174–180, 200.1, 201, 202, 5/282.1, 285, 286, 288
See application file for complete search history.

(56) References Cited

U.S. PATENT DOCUMENTS 3,761,971 A * 10/1973 Behnke ..... 5/201
4,196,484 A * 4/1980 Harris ..... 5/201
4,734,946 A * 4/1988 Saputo ..... 5/400
5,144,706 A * 9/1992 Walker ..... 5/400
5,243,720 A * 9/1993 Harrow ..... 5/201
5,894,614 A * 4/1999 Stroud ..... 5/200.1
5,970,537 A * 10/1999 Hanes et al. ..... 5/13
5,996,145 A * 12/1999 Taylor ..... 5/200.1
6,338,172 B1 * 1/2002 Taylor et al. ..... 5/200.1
6,557,191 B2 * 5/2003 Bellows et al. ..... 5/200.1
6,851,140 B2 * 2/2005 Polevoy et al. ..... 5/200.1
7,003,822 B1 * 2/2006 Sheehy ..... 5/201
7,363,664 B2 * 4/2008 Polevoy et al. ..... 5/200.1
7,437,783 B2 * 10/2008 Navarro et al. ..... 5/201
7,644,456 B2 * 1/2010 Polevoy et al. ..... 5/201
7,665,163 B2 * 2/2010 Polevoy et al. ..... 5/200.1
2006/0213008 A1 * 9/2006 Polevoy et al. ..... 5/310
2008/0222802 A1 * 9/2008 Harrow ..... 5/286
2012/0227180 A1 * 9/2012 Chung et al. ..... 5/400

* cited by examiner

*Primary Examiner* — William Kelleher
*Assistant Examiner* — David R Hare
(74) *Attorney, Agent, or Firm* — Alan Kamrath; Kamrath IP Lawfirm, P.A.

(57) ABSTRACT

A combination bed includes a front frame, a rear frame detachably connected with the front frame, and a connecting frame mounted between the front frame and the rear frame so that the front frame and the rear frame are supported and combined together by the connecting frame. The front frame includes a front support and two front bars each having a first end pivotally connected with the front support and a second end connected with the rear frame. The rear frame includes a rear support and two rear bars each having a first end pivotally connected with the rear support and a second end connected with the respective front bar. Thus, the front frame, the rear frame and the connecting frame can be connected and disconnected so that the combination bed is assembled and disassembled easily and quickly.

12 Claims, 6 Drawing Sheets

COMBINATION BED THAT IS ASSEMBLED AND DISASSEMBLED EASILY AND QUICKLY

BACKGROUND OF THE INVENTION

1. Field of the Invention

The present invention relates to a bed and, more particularly, to a combination bed used in a house.

2. Description of the Related Art

A conventional bed comprises a headboard, a footboard spaced from the headboard, a support frame mounted between the headboard and the footboard, a stand mounted on the bottom of the support frame, and a mattress mounted on the top of the support frame. However, the conventional bed has a larger fixed volume and cannot be detached to have a smaller volume before assembly, thereby greatly causing inconvenience in and increasing the cost of packaging, storage and transportation of the conventional bed. In addition, the conventional bed cannot be assembled and disassembled easily and quickly.

BRIEF SUMMARY OF THE INVENTION

In accordance with the present invention, there is provided a combination bed, comprising a front frame, a rear frame detachably connected with the front frame, and a connecting frame mounted between the front frame and the rear frame so that the front frame and the rear frame are supported and combined together by the connecting frame. The front frame includes a front support and two front bars each having a first end pivotally connected with the front support and a second end connected with the rear frame. The second end of each of the front bars has a face provided with a front locking member. The rear frame includes a rear support and two rear bars each having a first end pivotally connected with the rear support and a second end connected with a respective one of the front bars of the front frame. The second end of each of the rear bars has a face provided with a rear locking member. The connecting frame has two opposite ends each provided with two locking pieces, wherein one of the locking pieces of the connecting frame is locked onto the front locking member of a respective one of the front bars, and the other one of the locking pieces of the connecting frame is locked onto the rear locking member of a respective one of the rear bars.

The primary objective of the present invention is to provide a combination bed that is assembled and disassembled easily and quickly.

According to the primary advantage of the present invention, the front frame, the rear frame and the connecting frame can be connected and disconnected so that the combination bed is assembled and disassembled easily and quickly.

According to another advantage of the present invention, the combination bed can be detached to have a smaller volume before assembly, thereby greatly facilitating and saving the cost of packaging, storage and transportation of the combination bed.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
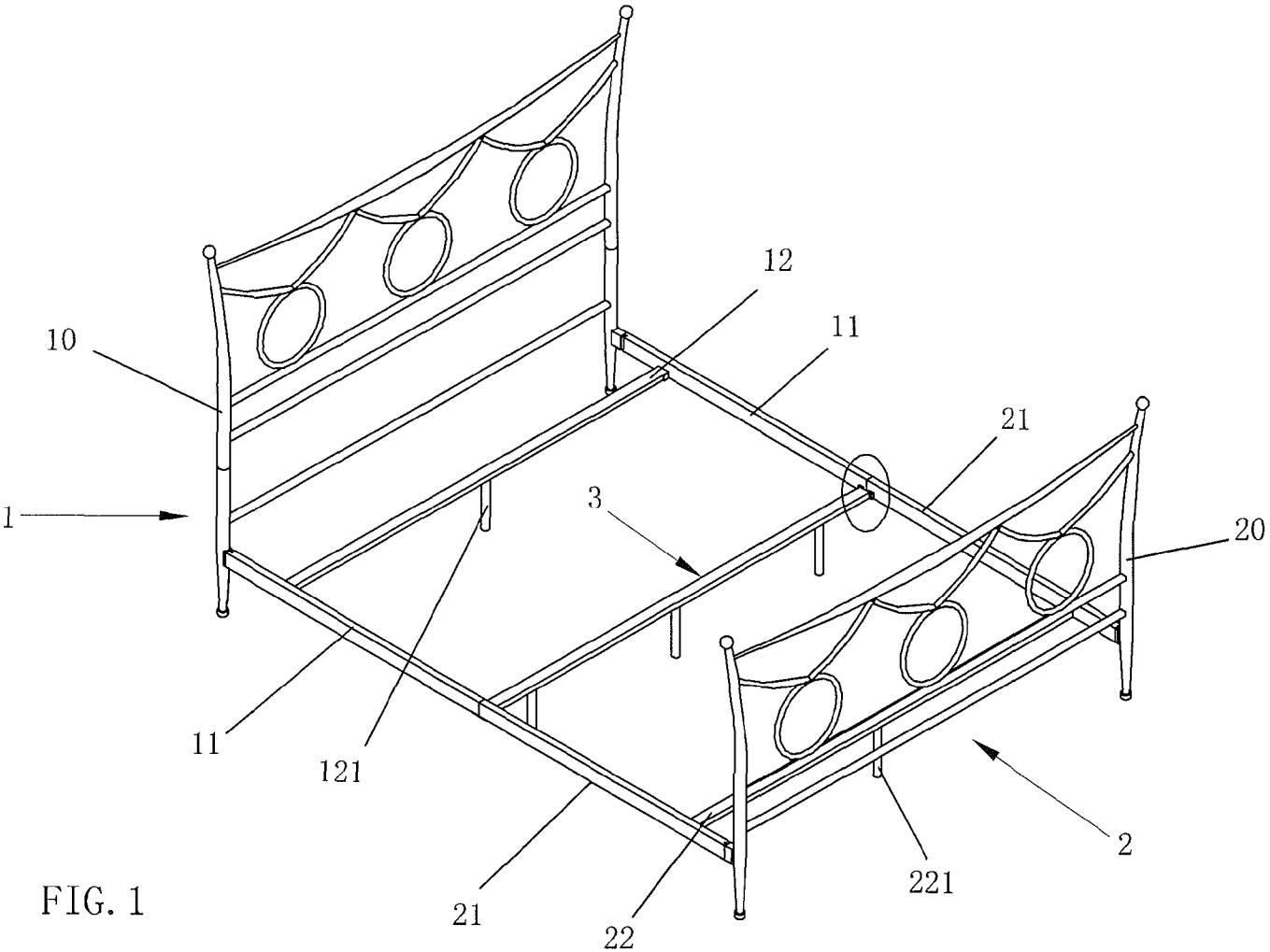
FIG. 1 is a perspective view of a combination bed in accordance with the preferred embodiment of the present invention.
Figure 2:
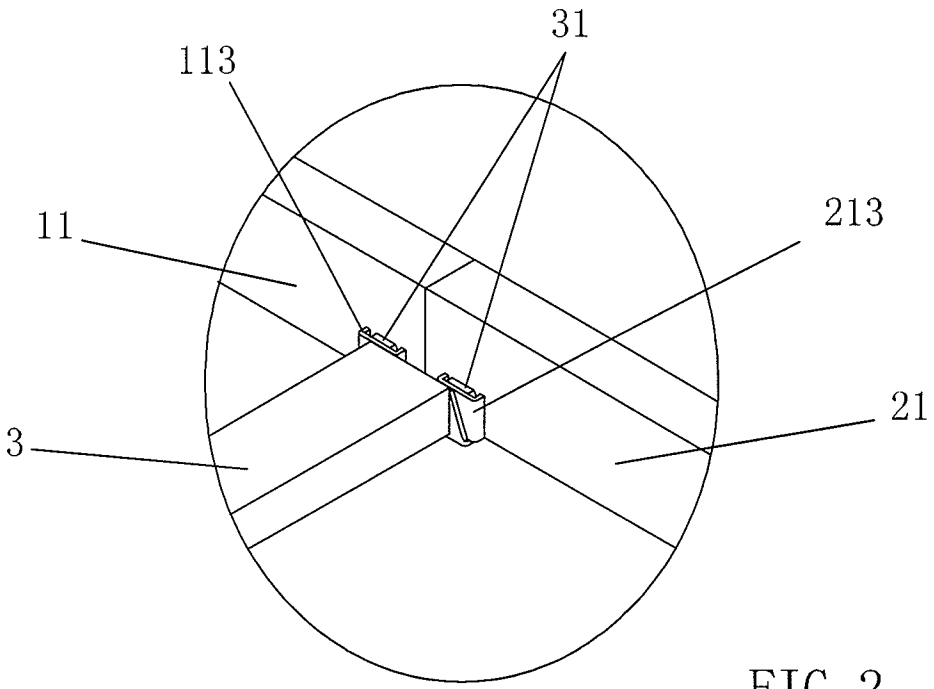
FIG. 2 is a locally enlarged view of the combination bed as shown in FIG. 1.
Figure 3:
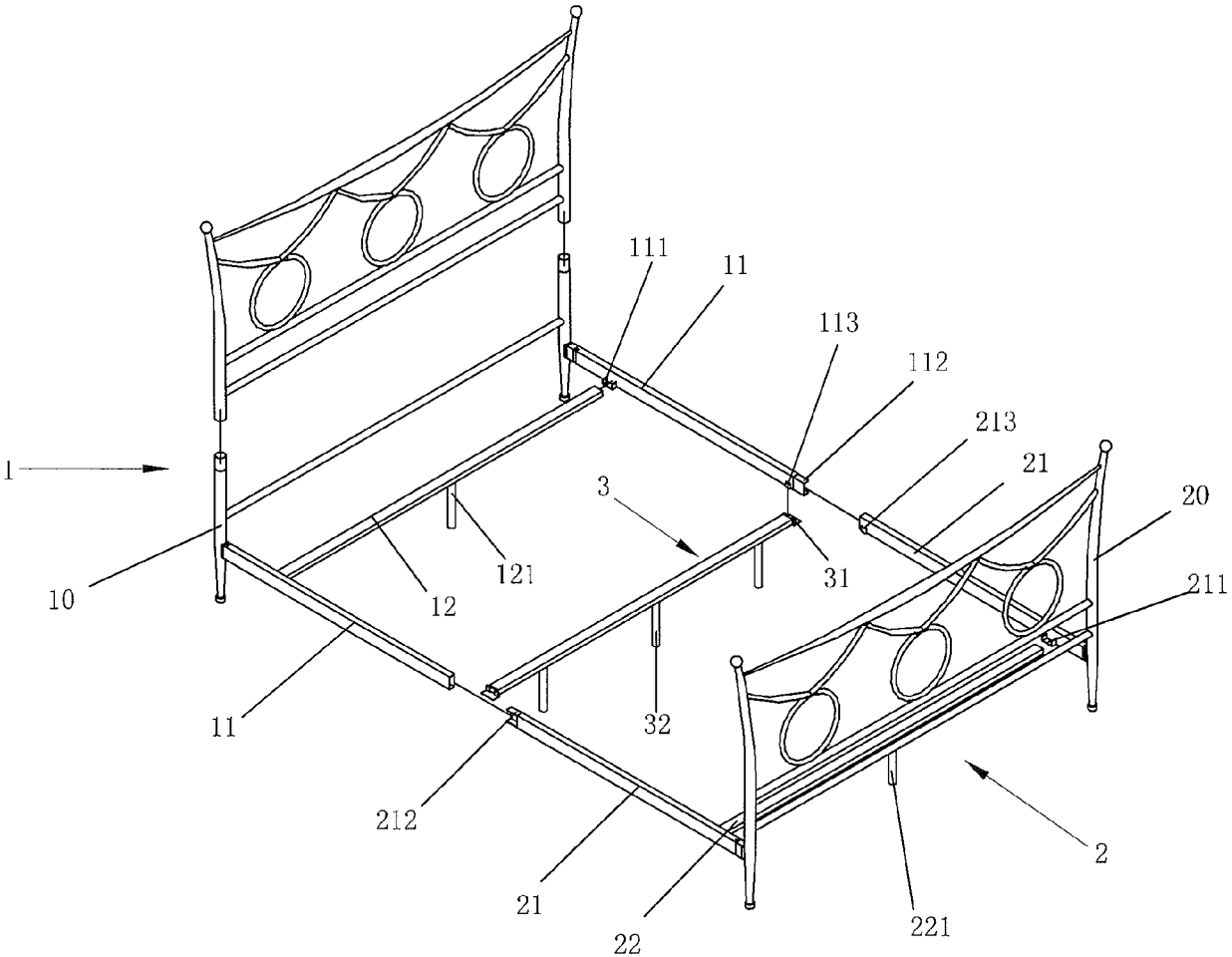
FIG. 3 is an exploded perspective view of the combination bed as shown in FIG. 1.
Figure 4:
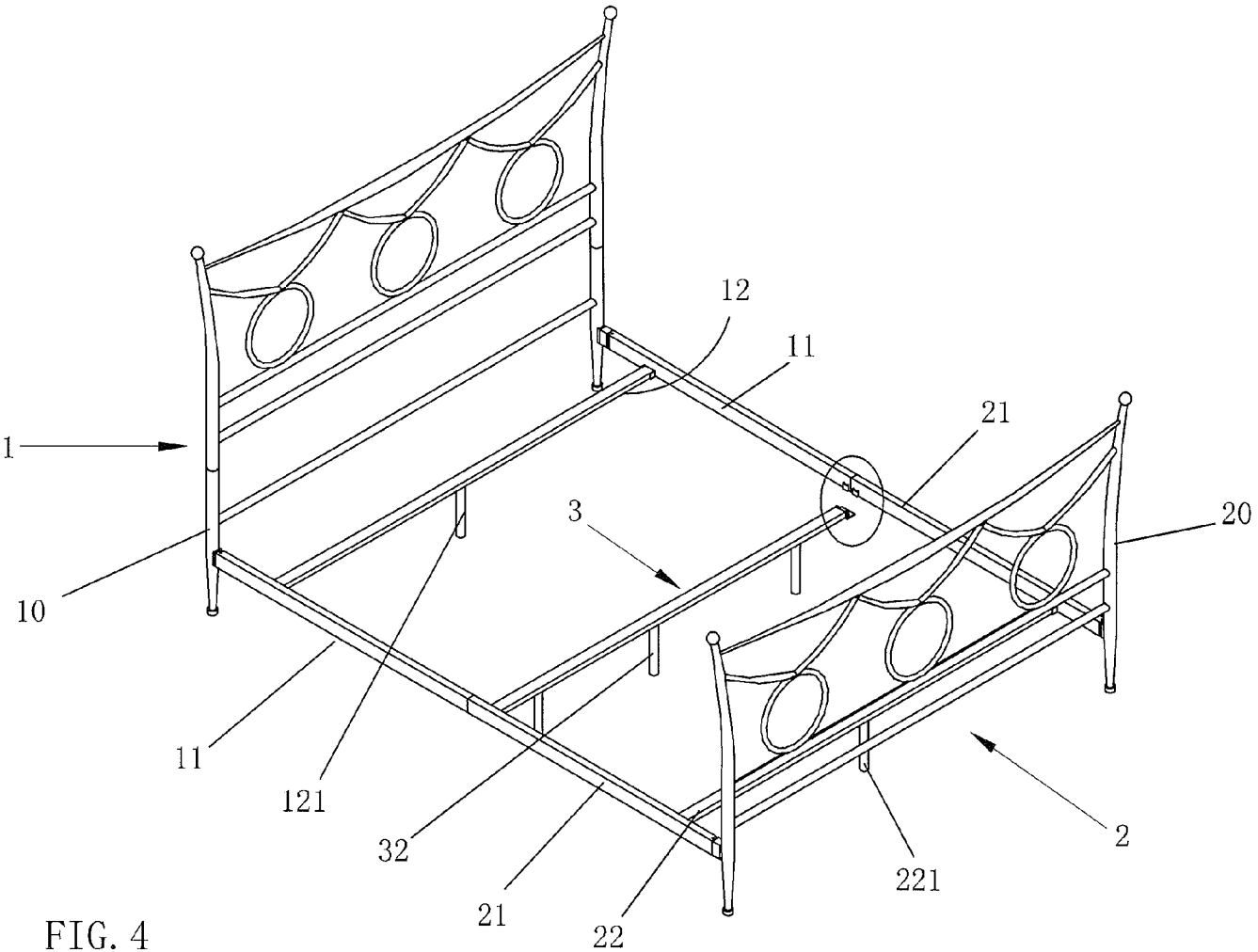
FIG. 4 is a partially exploded perspective view of the combination bed as shown in FIG. 1.
Figure 5:
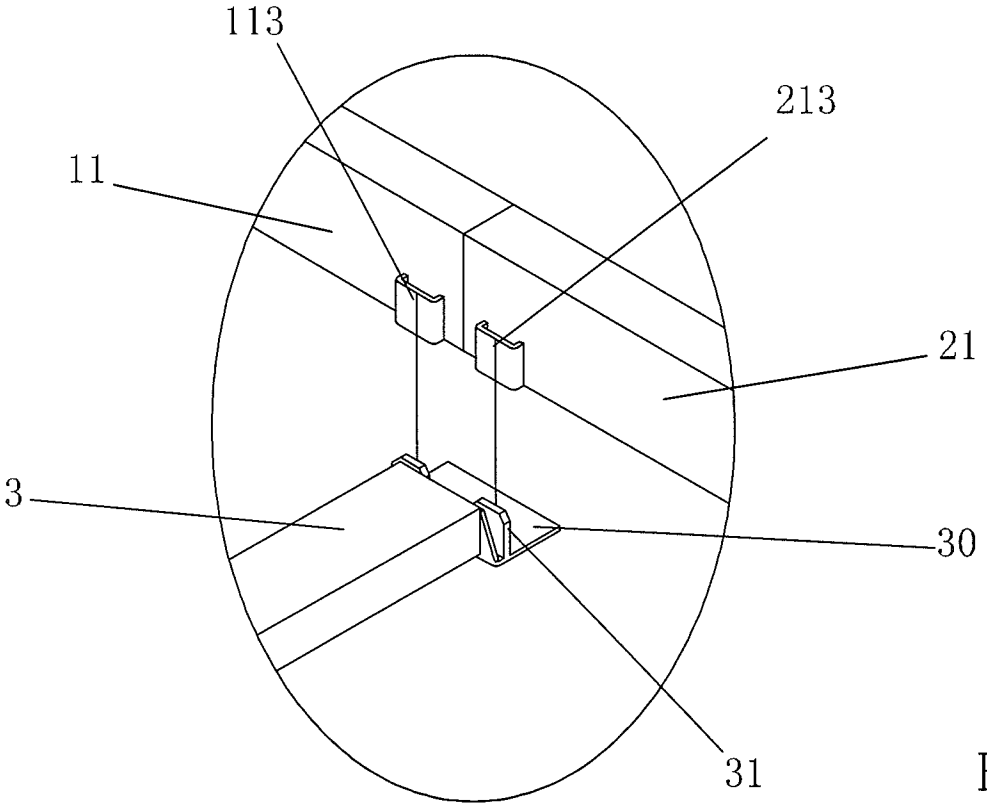
FIG. 5 is a locally enlarged view of the combination bed as shown in FIG. 4.

Referring to the drawings and initially to FIGS. 1-5, a combination bed in accordance with the preferred embodiment of the present invention comprises a front frame 1, a rear frame 2 detachably connected with the front frame 1, and a connecting frame 3 mounted between the front frame 1 and the rear frame 2 so that the front frame 1 and the rear frame 2 are supported and combined together by the connecting frame 3.

The front frame 1 includes a front support 10, two front bars 11 each having a first end pivotally connected with the front support 10 and a second end connected with the rear frame 2, and a front connecting bar 12 mounted between the front bars 11. Each of the front bars 11 of the front frame 1 has a side provided with a mounting portion 111 connected with the front connecting bar 12. The second end of each of the front bars 11 has a face provided with a front locking member 113. The front connecting bar 12 of the front frame 1 has two opposite ends each mounted on the mounting portion 111 of a respective one of the front bars 11. The front connecting bar 12 of the front frame 1 has a bottom provided with a front leg 121 abutting the ground.

The rear frame 2 includes a rear support 20, two rear bars 21 each having a first end pivotally connected with the rear support 20 and a second end connected with a respective one of the front bars 11 of the front frame 1, and a rear connecting bar 22 mounted between the rear bars 21. Each of the rear bars 21 of the rear frame 2 has a side provided with a mounting section 211 connected with the rear connecting bar 22. The second end of each of the rear bars 21 is juxtaposed to the second end of the respective front bar 11. The second end of each of the rear bars 21 has a face provided with a rear locking member 213. The rear connecting bar 22 of the rear frame 2 has two opposite ends each mounted on the mounting section 211 of a respective one of the rear bars 21. The rear connecting bar 22 of the rear frame 2 has a bottom provided with a rear leg 221 abutting the ground.

The connecting frame 3 has a bottom provided with at least one support leg 32 abutting the ground. The connecting frame 3 has two opposite ends each provided with two locking pieces 31, wherein one of the locking pieces 31 of the connecting frame 3 is locked onto the front locking member 113 of a respective one of the front bars 11, and the other one of the locking pieces 31 of the connecting frame 3 is locked onto the rear locking member 213 of a respective one of the rear bars 21. Preferably, one of the locking pieces 31 of the connecting frame 3 is inserted into the front locking member 113 of the respective front bar 11 from a bottom of the front locking member 113, and the other one of the locking pieces 31 of the connecting frame 3 is inserted into the rear locking member 213 of the respective rear bar 21 from a bottom of the rear locking member 213. Each of the opposite ends of the connecting frame 3 is provided with a bottom plate 30 abutting a bottom of the respective front bar 11 and the respective rear bar 21. Each of the locking pieces 31 of the connecting frame 3 is formed on and extended upward from the bottom plate 30.

In the preferred embodiment of the present invention, the second end of one of the front bars 11 has an end portion provided with a protruding front connecting portion 112, and the second end of one of the rear bars 21 has an end portion provided with a protruding rear connecting portion 212. Thus, the front connecting portion 112 of one of the front bars 11 is inserted into and connected with the second end of the other one of the rear bars 21, and the rear connecting portion 212 of one of the rear bars 21 is inserted into and connected with the second end of the other one of the front bars 11.

In assembly, each of the two opposite ends of the front connecting bar 12 is mounted on the mounting portion 111 of the respective front bar 11 so that the front connecting bar 12 of the front frame 1 is mounted between the front bars 11. Then, each of the two opposite ends of the rear connecting bar 22 is mounted on the mounting section 211 of the respective rear bar 21 so that the rear connecting bar 22 of the rear frame 2 is mounted between the rear bars 21. Then, the front connecting portion 112 of one of the front bars 11 is inserted into the second end of the other one of the rear bars 21, and the rear connecting portion 212 of one of the rear bars 21 is inserted into the second end of the other one of the front bars 11 so that the front bars 11 of the front frame 1 are connected with the rear bars 21 of the rear frame 2 respectively. Then, one of the locking pieces 31 of the connecting frame 3 is inserted into the front locking member 113 of the respective front bar 11 from the bottom of the front locking member 113, and the other one of the locking pieces 31 of the connecting frame 3 is inserted into the rear locking member 213 of the respective rear bar 21 from the bottom of the rear locking member 213 so that the connecting frame 3 is mounted between the front frame 1 and the rear frame 2. At this time, the locking pieces 31 of the connecting frame 3 are closely combined with the front locking member 113 of each of the front bars 11 and the rear locking member 213 of each of the rear bars 21 by the gravity of the front bars 11 of the front frame 1 and the rear bars 21 of the rear frame 2 so that the connecting frame 3 is mounted between the front frame 1 and the rear frame 2 solidly and stably.

On the contrary, when the user wishes to dismantle the combination bed, one of the locking pieces 31 of the connecting frame 3 is detached from the front locking member 113 of the respective front bar 11, and the other one of the locking pieces 31 of the connecting frame 3 is detached from the rear locking member 213 of the respective rear bar 21 so that the connecting frame 3 is detached from the front frame 1 and the rear frame 2. Then, the front connecting portion 112 of one of the front bars 11 is detached from the second end of the other one of the rear bars 21, and the rear connecting portion 212 of one of the rear bars 21 is detached from the second end of the other one of the front bars 11 so that the front bars 11 of the front frame 1 are detached from the rear bars 21 of the rear frame 2 respectively. Then, each of the two opposite ends of the rear connecting bar 22 is detached from the mounting section 211 of the respective rear bar 21 so that the rear connecting bar 22 of the rear frame 2 is detached from the rear bars 21. Then, each of the two opposite ends of the front connecting bar 12 is detached from the mounting portion 111 of the respective front bar 11 so that the front connecting bar 12 of the front frame 1 is detached from the front bars 11.

Figure 6:
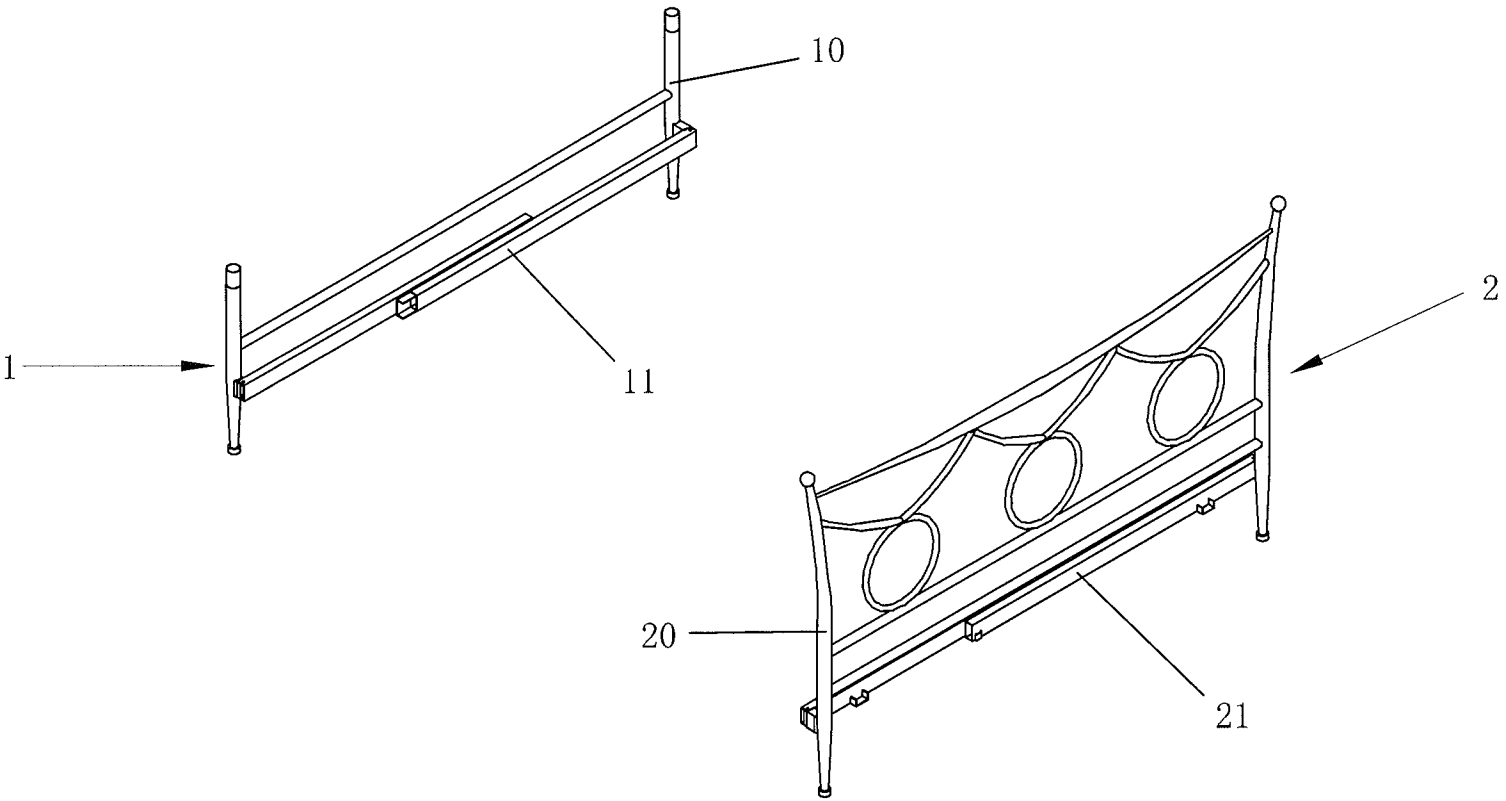
FIG. 6 is a folded view of a front frame and a rear frame of the combination bed as shown in FIG. 1.

As shown in FIG. 6, the front bars 11 of the front frame 1 are folded, and the rear bars 21 of the rear frame 2 are folded so that the front frame 1 and the rear frame 2 are folded when not in use to reduce the volume of the combination bed.

Accordingly, the front frame 1, the rear frame 2 and the connecting frame 3 can be connected and disconnected so that the combination bed is assembled and disassembled easily and quickly. In addition, the combination bed can be detached to have a smaller volume before assembly, thereby greatly facilitating and saving the cost of packaging, storage and transportation of the combination bed.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A combination bed comprising:

a front frame;

a rear frame detachably connected with the front frame; and a connecting frame mounted between the front frame and the rear frame with the front frame and the rear frame supported and combined together by the connecting frame, wherein:

the front frame includes:

a front support; and two front bars each having a first end pivotally connected with the front support and a second end connected with the rear frame;

the second end of each of the two front bars has a face provided with a front locking member;

the rear frame includes:

a rear support; and two rear bars each having a first end pivotally connected with the rear support and a second end connected with a respective one of the two front bars of the front frame;

the second end of each of the two rear bars has a face provided with a rear locking member;

the connecting frame has two opposite ends each provided with two locking pieces;

one of the two locking pieces of the connecting frame is locked onto the front locking member of a respective one of the two front bars;

another one of the two locking pieces of the connecting frame is locked onto the rear locking member of a respective one of the two rear bars;

the one of the two locking pieces of the connecting frame is inserted into the front locking member of the respective one of the two front bars from a bottom of the front locking member; and the other one of the two locking pieces of the connecting frame is inserted into the rear locking member of the respective one of the two rear bars from a bottom of the rear locking member.

2. The combination bed of claim 1, wherein:

the second end of one of the two front bars has an end portion provided with a protruding front connecting portion;

the second end of one of the two rear bars has an end portion provided with a protruding rear connecting portion;

the protruding front connecting portion is inserted into and connected with the second end of another one of the two rear bars; and the protruding rear connecting portion is inserted into and connected with the second end of another one of the two front bars.

3. The combination bed of claim 1, wherein the connecting frame has a bottom provided with at least one support leg abutting the ground.

4. The combination bed of claim 1, wherein the front frame further includes a front connecting bar mounted between the two front bars.

5. The combination bed of claim 4, wherein:

each of the two front bars of the front frame has a side provided with a mounting portion connected with the front connecting bar; and the front connecting bar of the front frame has two opposite ends each mounted on the mounting portion of a respective one of the two front bars.

6. The combination bed of claim 4, wherein the front connecting bar of the front frame has a bottom provided with a front leg abutting the ground.

7. The combination bed of claim 1, wherein the rear frame further includes a rear connecting bar mounted between the two rear bars.

8. The combination bed of claim 7, wherein:

each of the two rear bars of the rear frame has a side provided with a mounting section connected with the rear connecting bar; and the rear connecting bar of the rear frame has two opposite ends each mounted on the mounting section of a respective one of the two rear bars.

9. The combination bed of claim 7, wherein the rear connecting bar of the rear frame has a bottom provided with a rear leg abutting the ground.

10. The combination bed of claim 1, wherein the second end of each of the two rear bars is juxtaposed to the second end of a respective front bar.

11. The combination bed of claim 1, wherein each of the two opposite ends of the connecting frame is provided with a bottom plate abutting a bottom of a respective front bar and a respective rear bar.

12. The combination bed of claim 11, wherein each of the two locking pieces of the connecting frame is formed on and extended upward from the bottom plate.

* * * * *